US009993101B2

(12) United States Patent
Bryan

(10) Patent No.: US 9,993,101 B2
(45) Date of Patent: Jun. 12, 2018

(54) DEVICE ADAPTED TO FACILITATE INSERTION OF A HAND INTO A GLOVE

(71) Applicant: Beth Joan Bryan, Neillsville, WI (US)

(72) Inventor: Beth Joan Bryan, Neillsville, WI (US)

( * ) Notice: Subject to any disclaimer, the term of this patent is extended or adjusted under 35 U.S.C. 154(b) by 0 days. days.

(21) Appl. No.: 15/134,203

(22) Filed: Apr. 20, 2016

(65) Prior Publication Data

US 2016/0302602 A1 Oct. 20, 2016

Related U.S. Application Data

(60) Provisional application No. 62/149,888, filed on Apr. 20, 2015.

(51) Int. Cl.
*A47G 25/90* (2006.01)

(52) U.S. Cl.
CPC ..... *A47G 25/904* (2013.01); *A47G 25/90* (2013.01)

(58) Field of Classification Search
CPC ..... A47G 25/92; A47G 25/904; A44B 99/005
USPC ..... D2/641, 616, 617, 623; D32/59; D20/33
See application file for complete search history.

(56) References Cited

U.S. PATENT DOCUMENTS 429,890 A * 6/1890 Crispell ..... A47G 25/92 223/111
4,084,733 A * 4/1978 Perlmutter ..... D06F 59/04 223/78
4,697,724 A * 10/1987 Pitcher ..... D06F 59/04 2/158
5,913,461 A * 6/1999 Boudreau ..... D06F 59/04 223/78
D563,070 S * 2/2008 Palese ..... D32/59
D655,878 S * 3/2012 Hajduk ..... D06F 59/04 D32/59
D761,517 S * 7/2016 Dugger ..... D2/641
2011/0204105 A1* 8/2011 Kelly ..... A47G 25/904 223/111
2015/0190007 A1* 7/2015 Levelle ..... A47G 25/82 223/118

* cited by examiner

*Primary Examiner* — Ismael Izaguirre
(74) *Attorney, Agent, or Firm* — Dunlap Bennett & Ludwig PLLC

(57) ABSTRACT

A device adapted to facilitate insertion of a hand into a glove is provided. The device may include a body portion and a handle portion. The body portion may be generally hand-shaped, and include a palm portion and a plurality of digit portions adapted to accommodate the palm and finger portions, respectively, of a user's hand. The plurality of digit portions may provide concave grooves for slidably guiding the fingers of the user's hand. After the device has been partially slid into an inner portion of a predetermined glove, wherein the plurality of digit portions are at least partially received within the respective finger holes of the glove, the user's fingers may ride along the concaved grooves of the plurality of digit portions, guiding the user's fingers into the proper finger holes of the glove.

16 Claims, 6 Drawing Sheets

DEVICE ADAPTED TO FACILITATE INSERTION OF A HAND INTO A GLOVE

CROSS-REFERENCE TO RELATED APPLICATION

This application claims the benefit of priority of U.S. provisional application No. 62/149,888, filed 20 Apr. 2015, the contents of which are herein incorporated by reference.

BACKGROUND OF THE INVENTION

The present invention relates to glove wear and, more particularly, a device adapted to facilitate insertion of a hand into a glove.

For a small child or person with disabilities to put on gloves, getting the fingers into the proper finger holes is difficult, sometimes taking multiple attempts to get the glove on correctly.

As can be seen, there is a need for a device adapted to facilitate insertion of a hand into a glove.

SUMMARY OF THE INVENTION

In one aspect of the present invention, a glove-glider device including a handle portion joined to a planar body portion, wherein the body portion includes a plurality of digit portions extending away from the handle portion, and wherein the plurality of digit portions are adapted to accommodate a plurality of human fingers in a spaced apart arrangement; and each of the plurality of digit portions define a respective concave groove.

In another aspect of the present invention, the glove glider device includes a handle portion joined to a planar body portion in a nonparallel relationship relative to the body portion; a handle hole provided by the handle portion; the body portion having a plurality of digit portions, wherein the plurality of digit portions are adapted to accommodate a plurality of human fingers in a spaced apart arrangement, and wherein at least one digit portion of the plurality of digit portions is disposed in a nonparallel relationship relative to the remaining digit portions of the plurality of digit portions; a palm portion interconnecting the plurality of digit portions and the handle portion, wherein the palm portion is adapted to accommodate a human palm associated with the plurality of human fingers; and a gripping surface and an opposing reduced friction surface; and a peripheral wall provided along a periphery of the plurality of digit portions, wherein the peripheral wall has a transverse relationship relative to the plurality of digit portions so that a concavity is defined by the gripping surface coextensive with the peripheral wall.

In yet another aspect of the present invention, the glove glider device include a handle portion joined to a planar body portion, wherein the body portion includes a plurality of digit portions extending away from the handle portion, and wherein the plurality of digit portions are adapted to accommodate a plurality of human fingers in a spaced apart arrangement; and at least one peripheral wall provided along a portion of a periphery of each of the plurality of digit portions, wherein each peripheral wall has a transverse relationship relative to the plurality of digit portions, wherein the body portion provides a grooved surface and an opposing smooth surface, wherein the grooved surface is coextensive with each periphery of each of the plurality of digit portions, defining a concaved groove, wherein the body portion may alternatively provide a grooved surface and an opposing smooth surface, wherein the grooved surface is coextensive with the peripheral wall, defining a concavity, wherein in certain embodiments each perimeter wall extends along less than half of the periphery of each of the plurality of digit portions, and wherein other embodiments each perimeter wall extends at least half of the periphery of each of the plurality of digit portions, and further including a palm portion interconnecting the body portion and the handle portion, and wherein the palm portion is adapted to accommodate a human palm associated with the plurality of human fingers, further including a handle hole provided by the handle portion, wherein at least one digit portion of the plurality of digit portions is disposed in a nonparallel relationship relative to the remaining digit portions of the plurality of digit portions, and wherein the handle portion is disposed in a nonparallel relationship relative to the body portion.

These and other features, aspects and advantages of the present invention will become better understood with reference to the following drawings, description and claims.

DETAILED DESCRIPTION OF THE INVENTION

Figure 1:
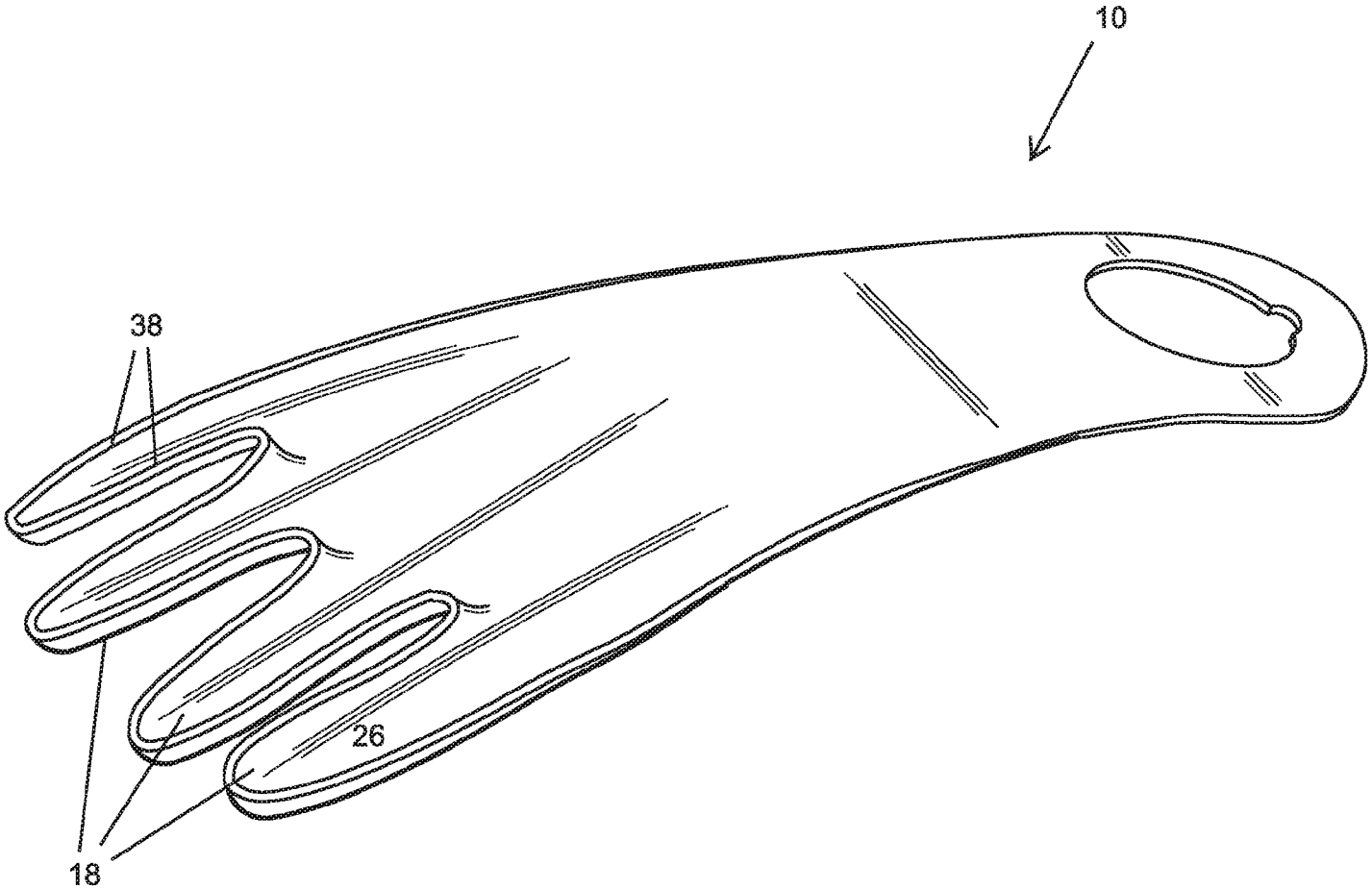
FIG. 1 is a perspective view of an exemplary embodiment of the present invention.
Figure 2:
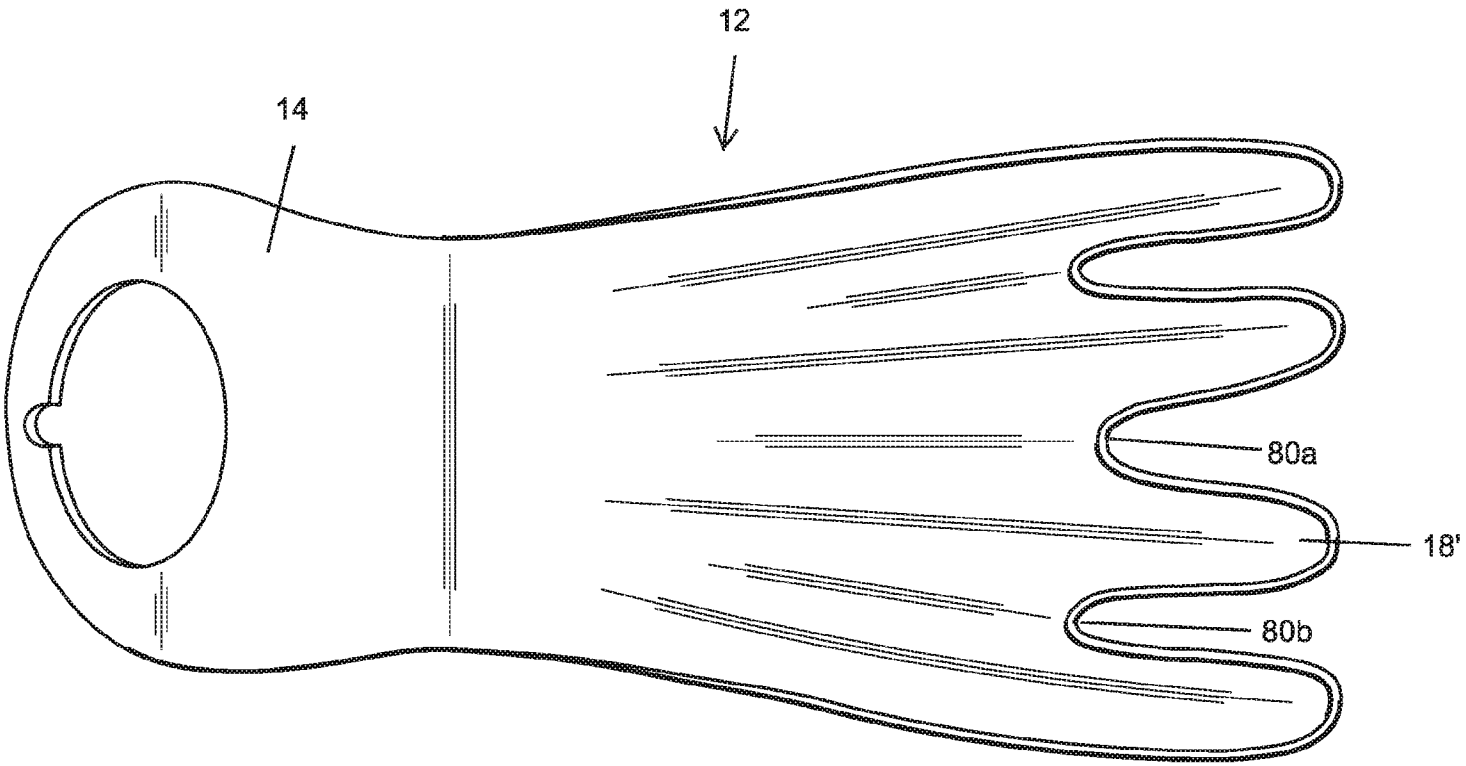
FIG. 2 is a top plan view of an exemplary embodiment of the present invention.
Figure 3:
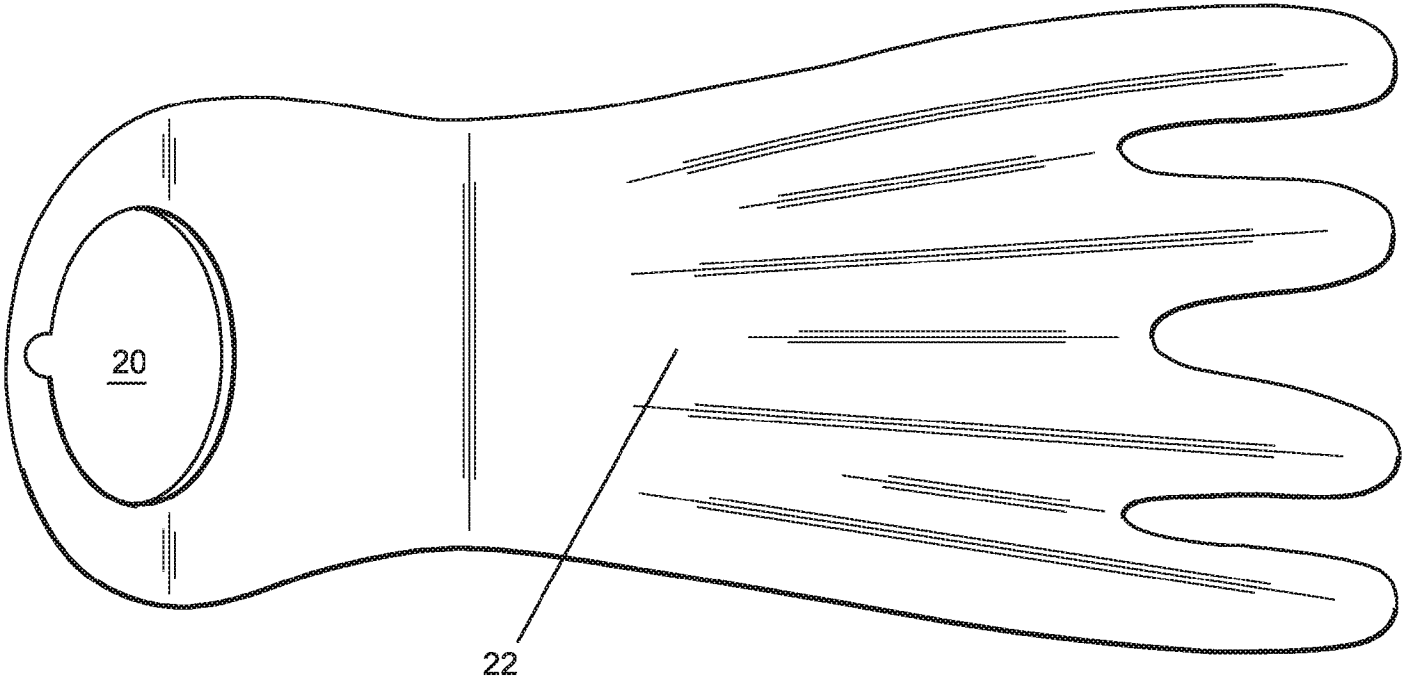
FIG. 3 is a bottom plan view of an exemplary embodiment of the present invention.
Figure 4:
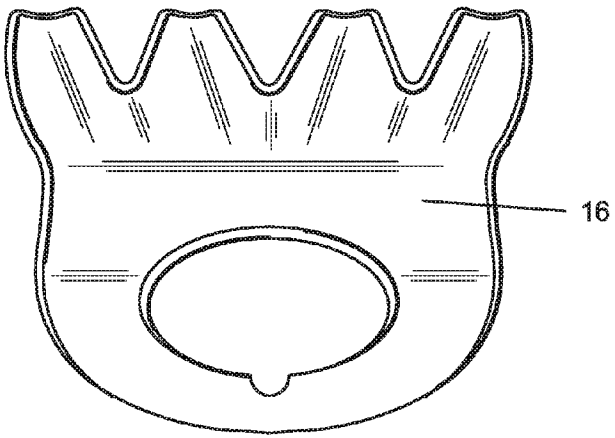
FIG. 4 is a rear perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a glove-glider device adapted to facilitate insertion of a hand into a glove. The device may include a body portion and a handle portion. The body portion may be generally hand-shaped, and include a palm portion and a plurality of digit portions adapted to accommodate the palm and finger portions, respectively, of a user's hand. The plurality of digit portions may provide concave grooves for slidably guiding the fingers of the user's hand. After the device has been partially slid into an inner portion of a predetermined glove, wherein the plurality of digit portions are at least partially received within the respective finger holes of the glove, the user's fingers may ride along the concaved grooves of the plurality of digit portions, guiding the user's fingers into the proper finger holes of the glove.

Referring now to FIGS. 1 through 5, the present invention may include a device 10 adapted to facilitate insertion of a user's hand 30 into a glove 50. The device 10 may include a body portion 12 and a handle portion 14. The body portion 12 may be generally hand-shaped, defining a palm portion 16 and a plurality of digit portions 18 extending, finger 32-like, from the palm portion 16. The palm portion 16 and the plurality of digit portions 18 are dimensioned and adapted to accommodate and support the palm and plurality of digits, respectively, of a human user. On the other end of the body portion 12, opposing the plurality of digit portions 18, the handle portion 14 may be disposed.

The body portion 12 may be made of a flexible material adapted or designed to be repeatedly bent without fracturing, such as plasticized or polymeric material. The flexible material may be moldable before forming the device 10. The body portion 12 may include a smooth surface 22 and a grooved surface 24.

A peripheral wall 28 may be provided along a periphery of the plurality of digit portions 18, wherein the peripheral wall 28 has a transverse relationship relative to the plurality of digit portions 18. In certain embodiments, the peripheral wall 28 may define a plurality of concave groves 26 coextensive with the plurality of digit portions 18. In another embodiment, each digit portions 18 may form the associated concave groove 26 with the necessity of the peripheral walls 28. In another embodiment, only a portion of each digit portions 18 may be circumscribed by a peripheral wall 28, wherein that portion of the peripheral wall 28 partially defines at least a portion of the concave grooves 26. The periphery of each digit portion 18 may be defined by a proximal end to the distal end of each such digit portion 18; for example, in FIG. 2, the periphery of the digit portion 18' is defined between reference numeral 80*a* and 80*b*.

Each concave groove 26 may be dimensioned and adapted to slidably engage at least the convex surface of a user's finger 32 so that they may easily ride or slide there along.

Figure 5:
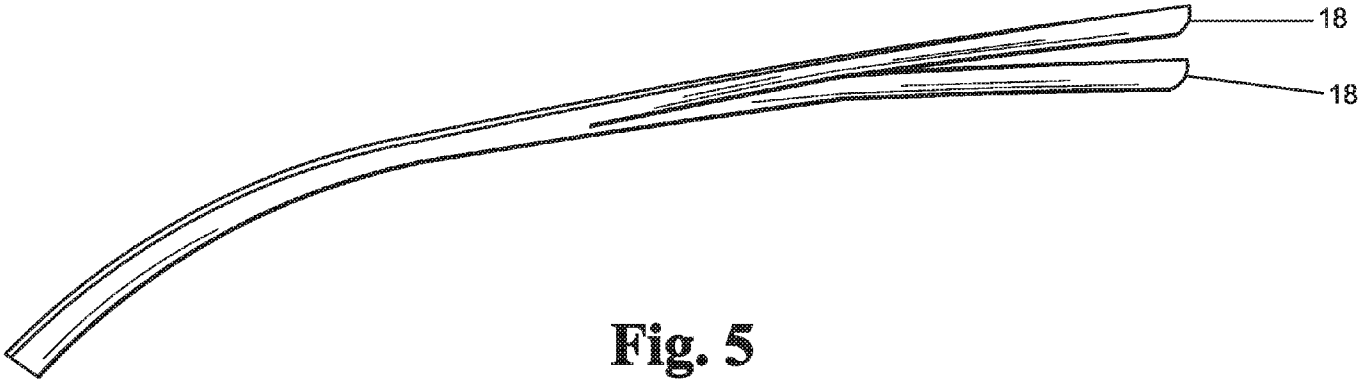
FIG. 5 is a side elevation view of an exemplary embodiment of the present invention.

Each of the plurality of digit portions 18 may extend from the palm portion 16 in a non-parallel relationship relative to each other, as illustrated in FIG. 5. Such non-parallel relationship may assist in their reception into the respective finger holes of a glove 50.

The handle portion 14 may define a handle hole 20 sized and adapted to be easy to grip with at least one finger 32. The handle portion 14 may be oriented in a non-planar relationship relative to the body portion 12. Such non-planar relationship may facilitate the gripping and removal of the device 10 during the final step of a method of using the present invention, as illustrated in FIG. 6*d*.

Figure 6A:
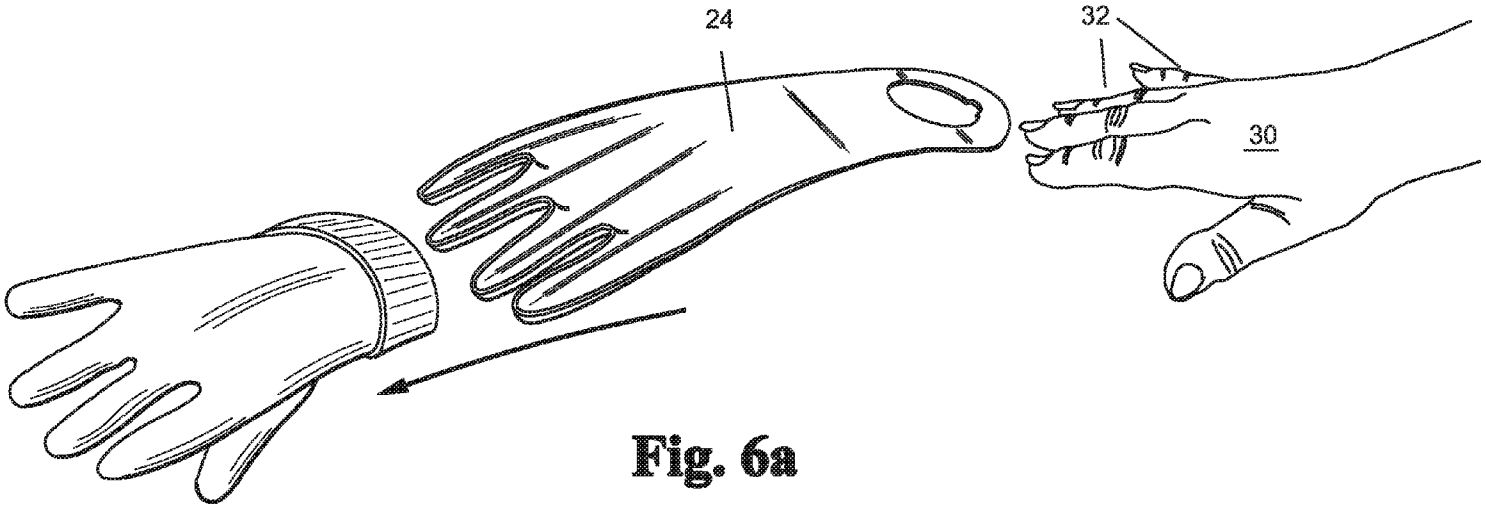
FIGS. 6*a* through 6*d* shows perspective views of an exemplary embodiment of the present invention, demonstrating operation.
Figure 6B:
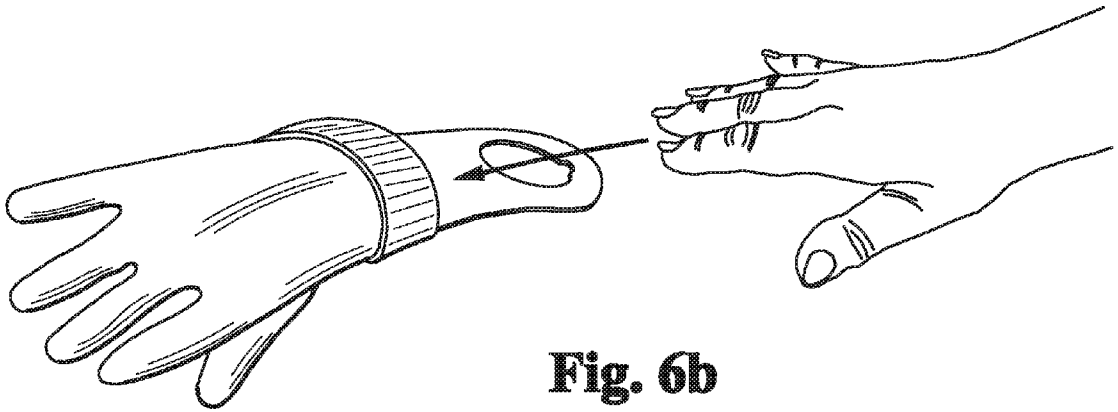
Figure 6C:
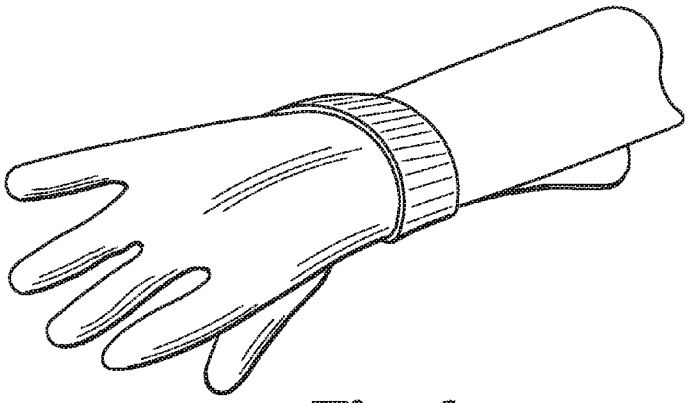
Figure 6D:
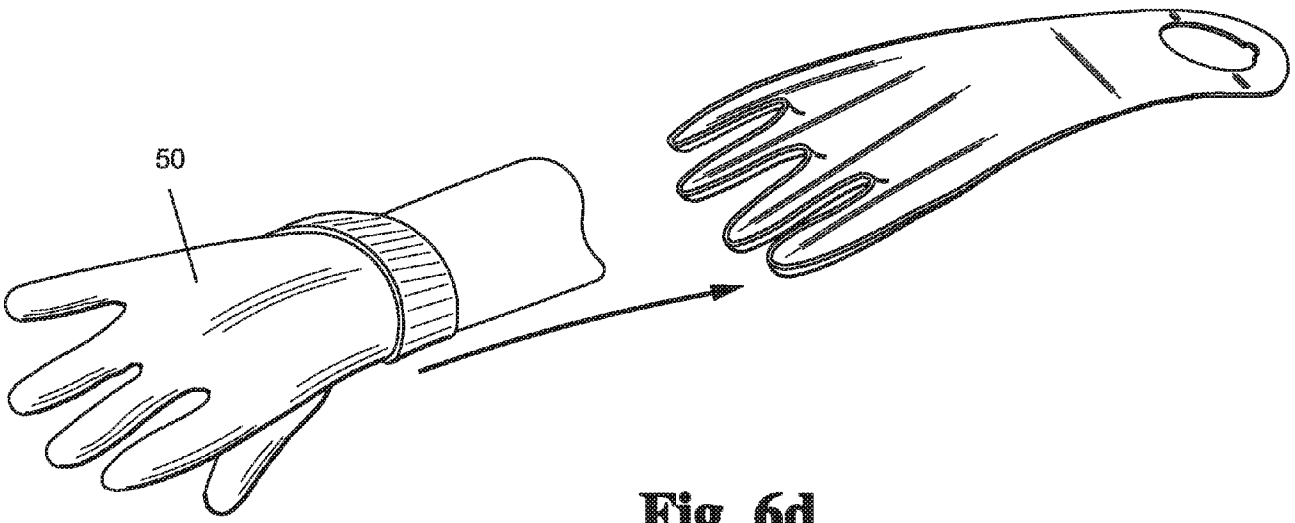

Referring to FIGS. 6*a* through 6*d*, a method of using the present invention may include the following. The device 10 disclosed above may be provided. The user may at least partially insert the digital portions 18, distal end first, into the respective finger holes of a desired glove 50 with the grooved surface 24 facing upward, as illustrated in FIG. 6*a*. Then the user may slide their finger 32, so that they ride along the plurality of concave grooves 26, guiding the user's fingers 32 into the proper finger holes of the glove, as illustrated in FIG. 6*b*, and in effect sandwiching the device 10 between a lower inner portion of the glove 50 and the user's hand 30, as illustrated in FIG. 6*c*. When the hand 30 is inserted into the glove 50, the device 10 may be drawn out by pulling on the handle portion 14, wherein the reduced friction smooth surface 22 facilitates such withdrawal, as illustrated in FIG. 6*d*.

It should be understood, of course, that the foregoing relates to exemplary embodiments of the invention and that modifications may be made without departing from the spirit and scope of the present invention.

What is claimed is:

1. A device, comprising:

a handle portion joined to a planar body portion, wherein the body portion includes a plurality of digit portions extending away from the handle portion, and wherein the plurality of digit portions are adapted to accommodate a plurality of human fingers in a spaced apart arrangement; and each of the plurality of digit portions defining a respective concave groove.

2. The device of claim 1, wherein the body portion provides a grooved surface and an opposing smooth surface, wherein the grooved surface is coextensive with the concave grooves.

3. The device of claim 2, further comprising a palm portion interconnecting the body portion and the handle portion, and wherein the palm portion is adapted to accommodate a human palm associated with the plurality of human fingers.

4. The device of claim 2, further comprising a handle hole provided by the handle portion.

5. The device of claim 2, wherein at least one digit portion of the plurality of digit portions is disposed in a nonparallel relationship relative to the remaining digit portions of the plurality of digit portions.

6. The device of claim 2, wherein the handle portion is disposed in a nonparallel relationship relative to the body portion.

7. A device, comprising:

a handle portion joined to a planar body portion in a nonparallel relationship relative to the body portion;

a handle hole provided by the handle portion;

the body portion comprising:

a plurality of digit portions, wherein the plurality of digit portions are adapted to accommodate a plurality of human fingers in a spaced apart arrangement, and wherein at least one digit portion of the plurality of digit portions is disposed in a nonparallel relationship relative to the remaining digit portions of the plurality of digit portions;

a palm portion interconnecting the plurality of digit portions and the handle portion, wherein the palm portion is adapted to accommodate a human palm associated with the plurality of human fingers; and a peripheral wall provided along a periphery of the plurality of digit portions, wherein the peripheral wall has a transverse relationship relative to the plurality of digit portions so that a concavity is defined by the grooved surface coextensive with the peripheral wall.

8. A device, comprising:

a handle portion joined to a planar body portion, wherein the body portion includes a plurality of digit portions extending away from the handle portion, and wherein the plurality of digit portions are adapted to accommodate a plurality of human fingers in a spaced apart arrangement; and at least one peripheral wall provided along a portion of a periphery of each of the plurality of digit portions, wherein each peripheral wall has a transverse relationship relative to the plurality of digit portions, and wherein each of the plurality of digit portions defining a respective concave groove.

9. The device of claim 8, wherein the body portion provides a grooved surface and an opposing smooth surface, wherein the grooved surface is coextensive with each periphery of each of the plurality of digit portions, defining a concaved groove.

10. The device of claim 9, further comprising a palm portion interconnecting the body portion and the handle portion, and wherein the palm portion is adapted to accommodate a human palm associated with the plurality of human fingers.

11. The device of claim 9, further comprising a handle hole provided by the handle portion.

12. The device of claim 9, wherein at least one digit portion of the plurality of digit portions is disposed in a nonparallel relationship relative to the remaining digit portions of the plurality of digit portions.

13. The device of claim 9, wherein the handle portion is disposed in a nonparallel relationship relative to the body portion.

14. The device of claim 8, wherein the body portion provides a grooved surface and an opposing smooth surface, wherein the grooved surface is coextensive with the peripheral wall, defining a concavity.

15. The device of claim 8, wherein each perimeter wall extends along less than half of the periphery of each of the plurality of digit portions.

16. The device of claim 8, wherein each perimeter wall extends at least half of the periphery of each of the plurality of digit portions.

* * * * *